United States Patent [19]

Yokota et al.

[11] Patent Number: 4,982,984

[45] Date of Patent: Jan. 8, 1991

[54] ACTIVE DOOR LATCH ASSEMBLY

[75] Inventors: Chitoshi Yokota, Saitama; Minoru Kawano, Miyazaki; Masahiko Sueyoshi, Miyazaki; Toshiro Nishida, Miyazaki; Shohachi Setoguchi, Miyazaki; Akira Fujimoto, Miyazaki, all of Japan

[73] Assignee: Honda Giken Kogyo Kabushiki Kaisha, Tokyo, Japan

[21] Appl. No.: 281,199

[22] Filed: Dec. 7, 1988

[30] Foreign Application Priority Data

| | | | |
|---|---|---|---|
| Dec. 7, 1987 | [JP] | Japan | 62-309262 |
| Dec. 7, 1987 | [JP] | Japan | 62-309263 |
| Dec. 7, 1987 | [JP] | Japan | 62-309264 |
| Dec. 7, 1987 | [JP] | Japan | 62-309265 |
| Dec. 7, 1987 | [JP] | Japan | 62-186134[U] |
| Dec. 7, 1987 | [JP] | Japan | 62-186135[U] |

[51] Int. Cl.[5] ..... E05B 47/00

[52] U.S. Cl. ..... 292/201; 292/341.16

[58] Field of Search ..... 292/201, 341.16, 144, 292/336.3

[56] References Cited

U.S. PATENT DOCUMENTS

| | | | |
|---|---|---|---|
| 2,896,990 | 7/1959 | Garvey et al. | 292/341.16 X |
| 2,916,319 | 12/1959 | Du Bois | 292/341.16 |
| 3,386,761 | 6/1968 | Johnstone et al. | 292/201 |
| 4,707,007 | 11/1987 | Inoh | 292/341.16 |
| 4,775,178 | 10/1988 | Boyko | 292/341.16 |

*Primary Examiner*—Richard E. Moore

*Attorney, Agent, or Firm*—Lyon & Lyon

[57] ABSTRACT

An active door latch assembly having a striker mounted on a vehicle body so as to be moveable towards and away from the vehicle body, a latch mechanism mounted on a vehicle door for latching the striker thereto upon closing of the door against the vehicle body, and a motor for moving the striker along the direction of the motion of the striker. A detector detects a latched stage of the latch mechanism, and a control circuit for activates the motor so as to move the striker away from the vehicle body when the detector has detected the unlatching of the latch mechanism and towards the vehicle body when the detector has detected the latching of the latch mechanism. Because the motor is activated upon detecting of the latching, premature or belated activation of the motor can be avoided. The detection can be accomplished by detecting the motor of either a latch member which engages the striker or a pawl which engages the latch member at its latched state.

9 Claims, 7 Drawing Sheets

ACTIVE DOOR LATCH ASSEMBLY

TECHNICAL FIELD

The present invention relates to an active door latch assembly which ensures easy and reliable closure of a vehicle door by moving the striker toward the center of the vehicle body when the vehicle door is about to be fully closed and moving the striker away from the center of the vehicle body when the vehicle door is about be to be opened. More particularly, the present invention relates to an improved active door latch assembly which can operate more reliably and more safely than was possible heretofore.

BACKGROUND OF THE INVENTION

It has been known that a considerable force is required to attain a full closure of a vehicle door not only because of the force required to fully latch the striker mounted on the vehicle body to the latch mechanism mounted on the vehicle door but also because of a strong resistance which the weather strip exerts against the force to close the door. To overcome this problem, U.S. Pat. No. 4,707,007 issued to Inoh and assigned to one of the joint assignees of the present application proposed an active door latch assembly which is provided with a striker mounted on a vehicle body so as to be moveable toward and away from the center of the vehicle body by a certain stroke; a latch mechanism mounted on a closure member such as a door for latching the striker thereto upon closing of the closure member upon the vehicle body; powered drive means for moving the striker toward and away from the vehicle body; a door switch for detecting an almost fully closed state of the door; and timer means for activating the powered drive means so as to move the striker towards the vehicle body shortly after the door switch has detected the almost fully closed state of the door, and away from the vehicle body when the door switch is slightly opened by unlatching the door.

According to this proposal, the door switch is required to be finely adjusted so as to detect the latched and unlatched state of the latch mechanism with a reasonable accuracy. However, it means a small dimensional tolerance, and requires considerable care in applying this invention to industrial applications. Additionally, the use of the timer involves a delayed action of the powered drive means, which may be helpful in increasing the safety of the system but may not be very attractive to the user of the vehicle.

BRIEF SUMMARY OF THE INVENTION

In view of such problems of the prior art, a primary object of the present invention is to provide an active door latch assembly which is reliable and offers a large dimensional tolerance.

A second object of the present invention is to provide an active door latch assembly which offers a high level of safety.

A third object of the present invention is to provide ac active door latch assembly which can finish its operation in a short time period without reducing its safety.

These and other objects of the present invention can be accomplished by providing an active door latch assembly, comprising: a striker mounted on a vehicle body so as to be moveable inwardly toward and outwardly away from the vehicle body by a certain stroke; a latch mechanism mounted on a closure member such as a door for latching the striker thereto upon closing of the closure member upon the vehicle body; powered drive means for moving the striker toward and away from the vehicle body; detecting means for detecting a latched state of the latch mechanism; and control means for activating the powered drive means so as to move the striker away from the vehicle body when the detecting means has detected the unlatching of the latch mechanism and towards the vehicle body when the detecting means has detected the latching of the latch mechanism.

Thus, it is ensured that the door latch is fully latched when the powered drive means is activated because the powered drive means is activated only when the fully latched state has been directly detected. Furthermore, when the door latch fails to be latched upon closing of the closure member or is half-latched, it is more easily detected than with a door having conventional latch mechanism because the closure member is more conspicuously spaced outwardly relative to the vehicle body than was the case in conventional door latch systems.

According to a preferred embodiment of the present invention, the latched state of the latch mechanism is detected by a limit switch which is activated by a moveable latch member of the latch mechanism when the latch member is at the latched position. Alternatively, the latched state may be detected by a limit switch which is activated by a pawl member which engages a latch member at its latched state.

Preferably, the powered drive means comprises an electric motor to move the striker, and the control means comprises a current detector for detecting the electric current supplied to the motor and stopping the motor when the detected electric current has exceeded a certain threshold level. This offers a reliable and compact structure. This feature is even more enhanced when the powered drive means comprises stopper means for limiting the stroke of the motion of the powered drive means, the stopper means comprising a concentric arcuate slot formed in a rotary member of the powered drive means, and a fixed pin which is received in the arcuate slot to define a limit to the rotational angle of the rotary member by abutting to a terminal end of the arcuate slot.

To prevent any undesirable consequences when any foreign object is inadvertently interposed between the closure member and the vehicle body when the closure member is about to be pulled toward the vehicle body by the powered drive means, the control means may comprise means to detect the position of the striker, and a current detector for detecting the electric current supplied to the motor and reversing the motor when the striker is at a position intermediate between limits of its permitted stroke of motion and, at the same time, the detected electric current has exceeded a certain threshold level.

To increase the safety of the active door latch assembly of the present invention, it is desirable to move the striker at a slower rate when moving the striker towards the vehicle body than when moving the striker away from the vehicle body.

To increase the operation reliability of the active door latch assembly of the present invention, it is desirable if the powered drive means comprises a power transmission mechanism which is irreversible in the sense that the striker is immobile against any external force applied directly thereto.

DETAILED DESCRIPTION OF THE PREFERRED EMBODIMENTS

Figure 1:
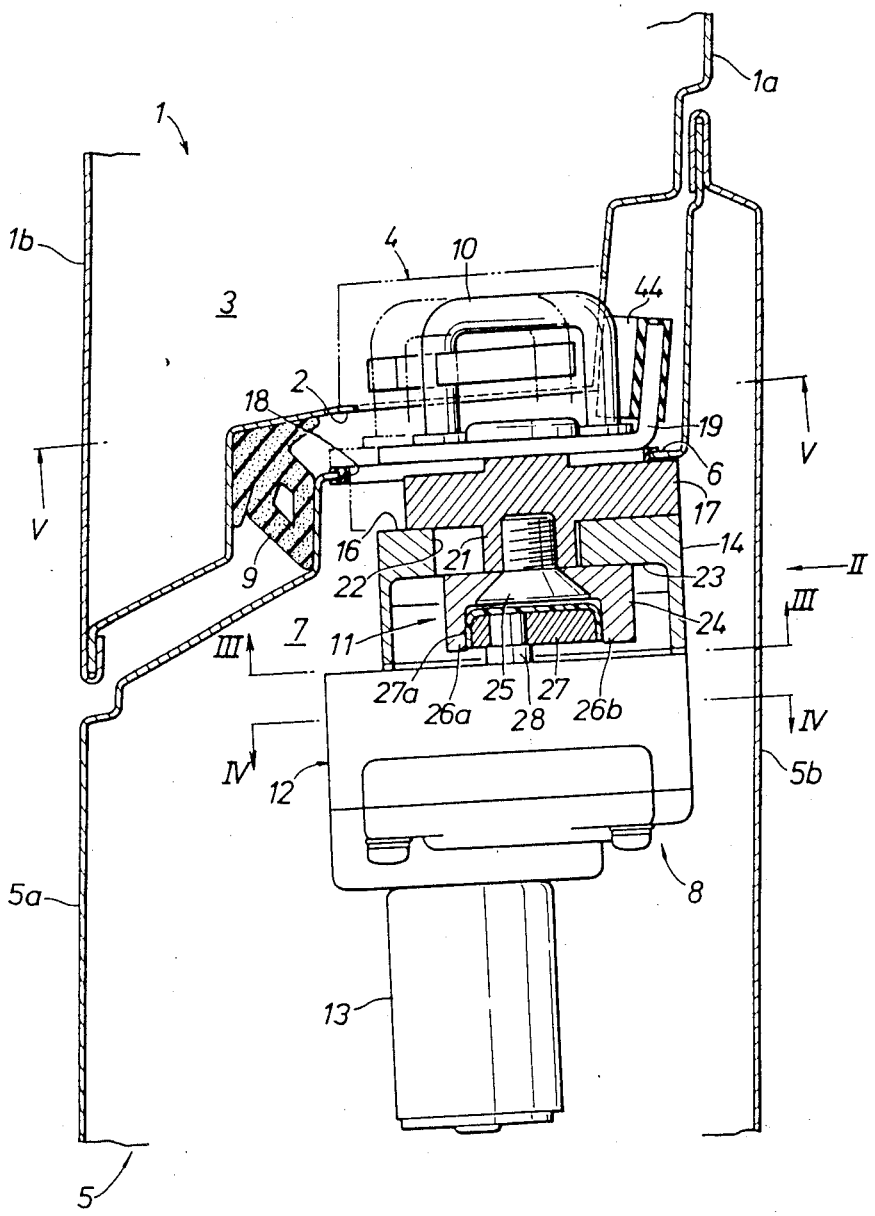
FIG. 1 is a sectional plan view of a first embodiment of the active door latch assembly according to the present invention.
Figure 2:
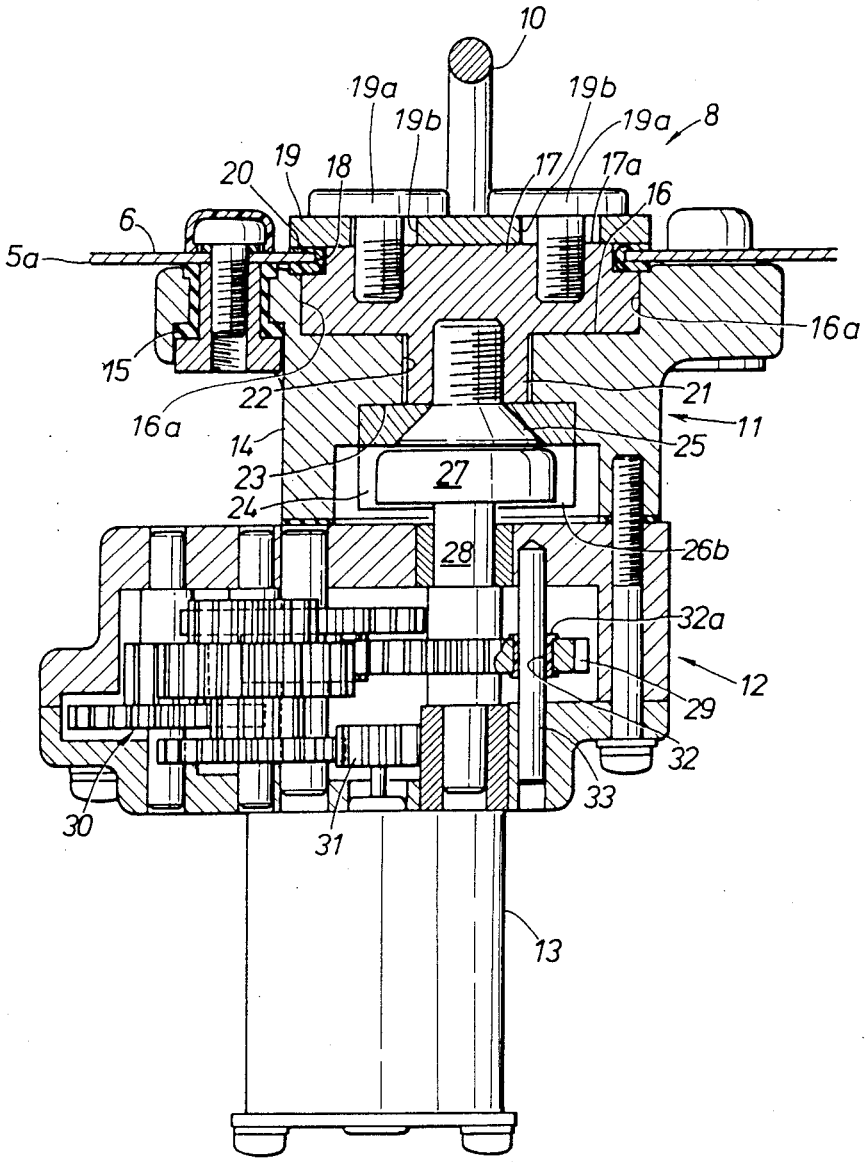
FIG. 2 is a sectional view as seen from the direction indicated by arrow II in FIG. 1.

FIGS. 1 and 2 show an essential part of a vehicle door to which a preferred embodiment of the door lock device according to the present invention is applied. A rotary latch device 4 is fixedly secured to the inner surface of the rear end wall 2 which is formed by bending a door inner panel 1*a* towards a door outer panel 1*b* to define a door inner space 3 in cooperation with the door outer panel 1*b*. A striker drive mechanism 8 is attached to the inner surface of a front wall 6 of a center pillar or a rear pillar which is formed by bending a body outer panel 5*a* towards a body inner panel 5*b* to define a body inner space 7 in cooperation with the body inner panel 5*b*. A weather strip 9 is attached to a convex corner of an external surface of the rear wall 2 of the door 1, and achieves a required sealing in cooperation with a corresponding surface area of the front wall 6 of the body outer panel 5*a*.

The striker drive mechanism 8 comprises a C-shaped striker 10 protruding from the front wall 6 of the body outer panel 5*a*, a cam mechanism 11 for moving the striker 10 along the opening and closing direction of the door 1, a DC motor 13, a reduction gear mechanism 12 for transmitting rotational power from the DC motor 13 to the cam mechanism 11, and a casing 14 of the cam mechanism 11 serving also as a mounting bracket for attaching the striker drive mechanism 8 on the vehicle body 5.

As best shown in FIG. 2, the casing 14 is mounted on the front wall 6 of the body outer panel 5*a*, by way of mount bushes 15 made of elastomer material, by means of screws. The mount bushes 15 effectively isolate the vibrations from the striker drive mechanism 8 from the vehicle body 5.

The mounting surface of the casing 14 is provided with a guide cavity 16 extending along the opening and closing direction of the door 1 and defined by a pair of planar lateral side walls 16*a*, and a slide member 17 is slidably received in this guide cavity 16. A base plate 19, to which the striker 10 is fixedly attached, is fixedly attached to an outer surface 17*a* of the slider member 17, with suitable fastening means such as screws, which is exposed from an opening 18 provided in the front wall 6 of the vehicle body 5. The base plate 19 which moves with the slider member 17 always overlaps with the opening 18 throughout its stroke of motion. The peripheral edge of the body outer panel 5*a* adjacent to this opening 18 is covered by a seal member 20 which seals the gaps between the front wall 6 and the slider member 17 and between the front wall 6 and the base plate 19 with a required lubricating capability. This seal member 20 is additionally provided with the function of isolating the vehicle body from the vibration of the striker drive mechanism 8.

The inner surface of the slider member 17 is provided with a projection 21 which is received in a slot 22 provided in the bottom of the cavity 16 in parallel with the lateral walls 16*a* of this cavity 16. The inner end surface of the casing 14 is provided with another guide cavity 23 extending in parallel with the guide cavity 16 and the slot 22 for slidably receiving a cam follower 24 therein. The cam follower 24 is fixedly attached to the free end surface of the projection 21 which is exposed to the interior of the guide cavity 23, by a screw 25.

Thus, the slider member 17 and the cam follower 24 can move over a range permitted by the slot 22 and are kept axially immovably restrained by the casing 14.

Figure 3:
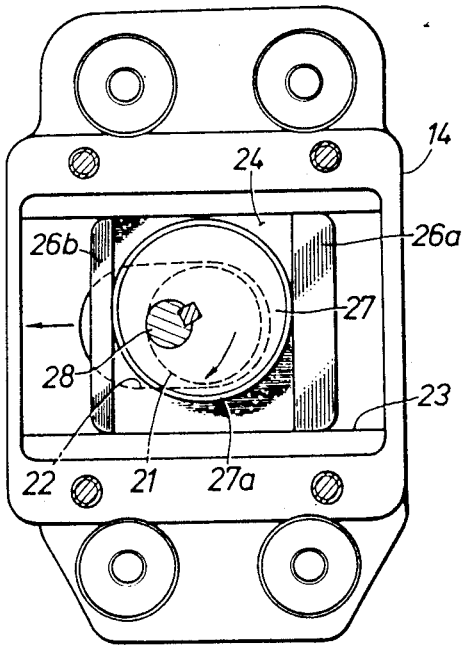
FIG. 3 is a sectional view taken along line III-III of FIG. 1.

As shown in FIGS. 1 and 3, the inner surface of the cam follower 24 is provided with a pair of mutually spaced upstanding walls 26*a* and 26*b* extending perpendicularly to the direction of the sliding motion of the cam follower 24 and parallel to each other. A circular, eccentric cam 27 is received in the space defined between these upstanding walls 26*a* and 26*b*. The peripheral surface of the eccentric cam 27 is covered by a layer of resin material 27*a* having a favorable lubricating property so as to attain a smooth sliding contact with the inner surfaces of the upstanding walls 26*a* and 26*b*.

Figure 4:
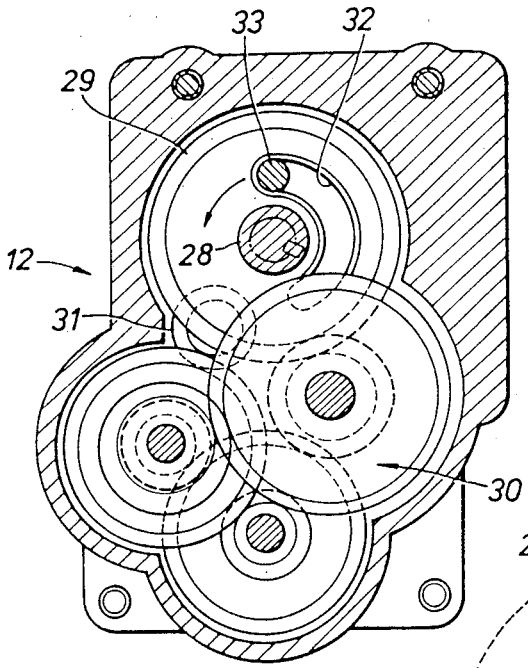
FIG. 4 is a sectional view taken along line IV-IV of FIG. 1.
Figure 6:
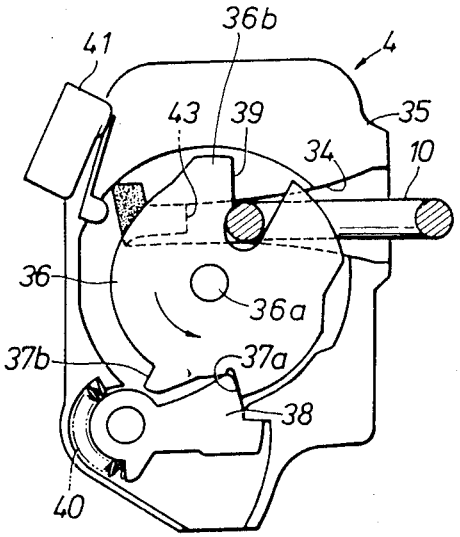
FIGS. 5 through 7 are simplified side views of the latch mechanism shown in FIGS. 1 and 2 to show its three different conditions.
Figure 5:
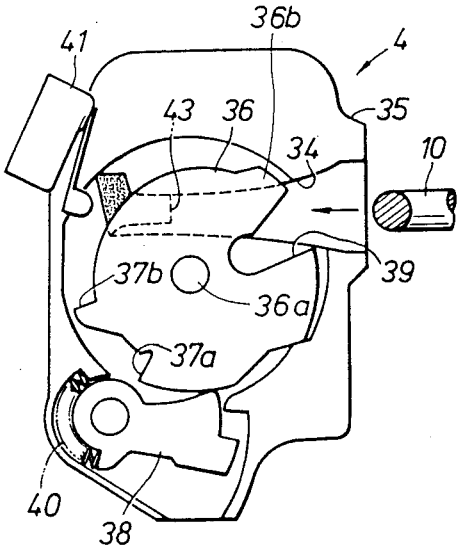
Figure 7:
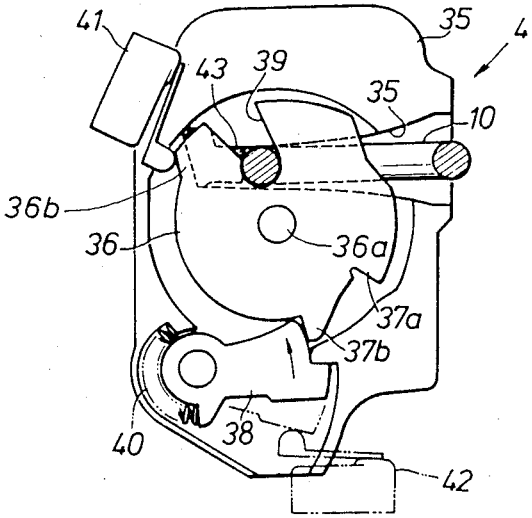

To the inner most end surface of the casing 14 is fixedly attached the reduction gear mechanism 12 which comprises, as best shown in FIG. 4, a cam shaft 28 which carries the eccentric cam 27 at its free end, a final gear 29 attached to this cam shaft 28, a pinion 31 which is fixedly attached to the output shaft of the DC motor 13, and a plurality of reduction gears 30 which are arranged between the pinion 31 and the final gear 29. The final gear 29 is provided with an arcuate slot 32 which spans an about 180-degree angle about the center of the cam shaft 28. In this slot 32 is received a pin 33 which is fixedly attached to the reduction gear casing at its both ends to define the permitted range of the rotational angle of the final gear 29. The inner surface of this slot 32 is also covered by a layer of resin material 32*a* to prevent the generation of metallic noises. The latch mechanism 4 is by itself of a known type as shown in FIGS. 5 through 7. Inside a casing 35, having a guide slot 34 for admitting the striker 10 therein, is provided a rotary latch member 36 which is pivotally supported by a central pin 36*a* so as to be rotatable by being pushed by the striker 10 against the spring force of a return spring not shown in the drawings, and a ratchet pawl 38 is also pivotally supported for engaging one of a pair of ratchet teeth 37*a* and 37*b* formed at suitable places in the periphery of the latch member 36 to prevent the returning motion of the latch member 36 at half-latch and full-latch positions against the spring force of the mentioned return spring. The latch member 36 is further provided with a notch 39 at a suitable location in the periphery thereof to receive the striker 10 therein. The ratchet pawl 38 is urged by a compression coil spring 40 into engagement with one of the ratchet teeth 37*a* or 37*b* in such a manner that, in either case, the ratchet pawl 38 permits the rotation of the latch member 36 in the direction to admit the striker 10 into the guide slot 34 but prevents the rotation of the latch member 36 in the direction to release the striker 10 from the guide slot 34.

A latch switch 41 consisting of a limit switch is provided adjacent to the inner most end of the guide slot 34 of the casing 35 to be activated by contact with a peripheral, radial projection 36*b* of the latch member 36 as the striker 10 is pushed sufficiently deep into the guide slot 34 and the latch member 36 has rotated to its final position.

Figure 8:
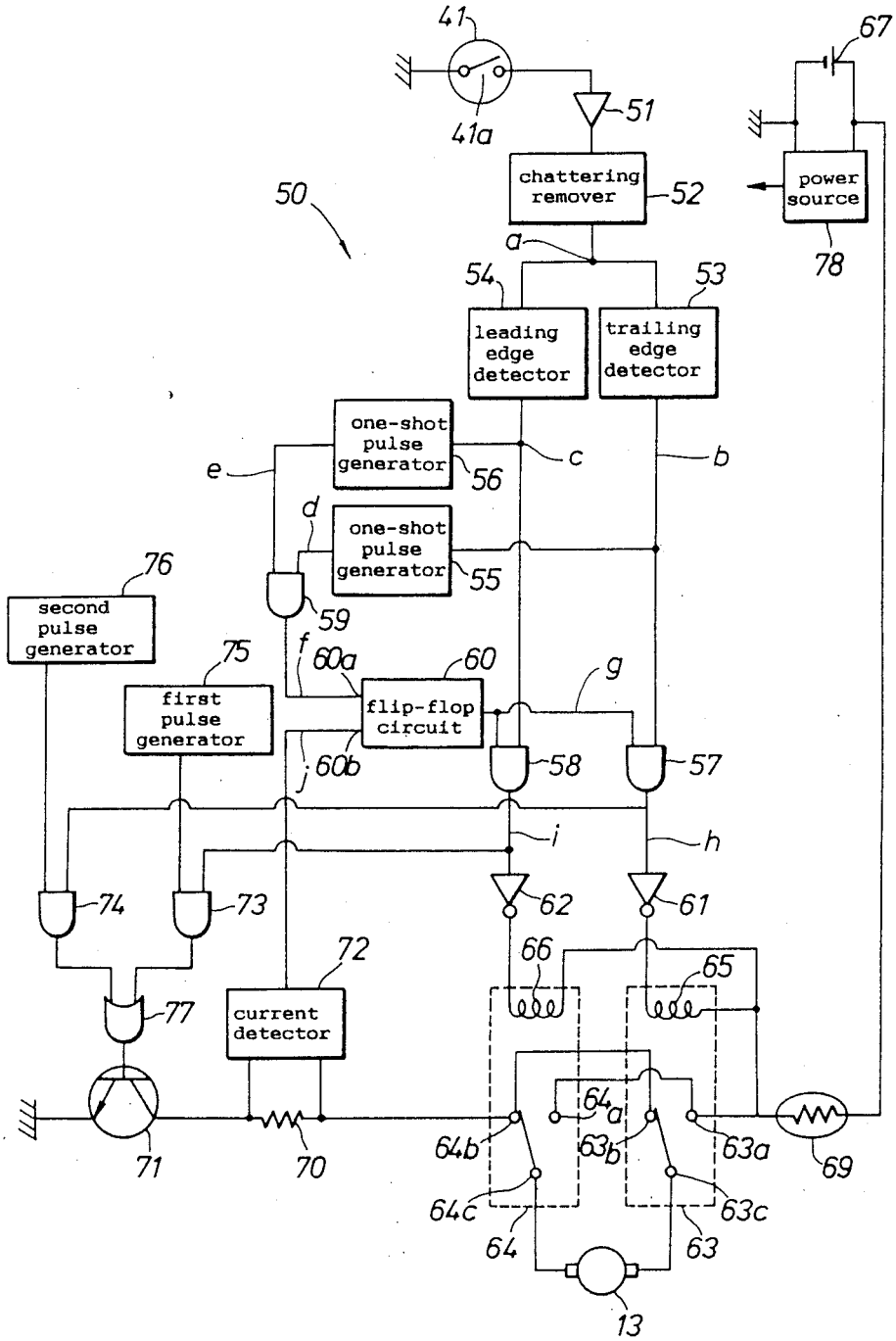
FIG. 8 is a block diagram of the control unit for the first embodiment.

Now the control circuit of the above described embodiment is described in the following with reference to FIG. 8.

This control circuit 50 comprises a pulse leading edge detecting circuit 53 and a pulse trailing edge detector 54 which are both connected the output of the normally closed contact set 41*a* of the latch switch 41 via a buffer circuit 51 and a chattering removal circuit 52. The output of the leading edge detecting circuit 53 is connected to a one-shot pulse generator 55 and one of the inputs of an AND circuit 57. The output of the trailing edge detecting circuit 54 is connected to another one-shot pulse generator 56 and one of the inputs of another AND circuit 58. The outputs of the two one-shot pulse generators 55 and 56 are connected to the inputs of a common AND circuit 59, whose output is connected to the set input of a flip-flop circuit 60. The output of the flip-flop circuit 60 is connected to the other inputs of the AND circuits 57 and 58. The outputs of these AND circuits 57 and 58 are connected the ground ends of the coils 65 and 66 of electromagnetic relays 63 and 64, respectively, via NOT circuits 61 and 62, respectively. The other ends of the coils 65 and 66 are connected, via a thermistor 69, to the positive end of an on-board battery 67 which is connected in parallel with a power source circuit 78.

The electromagnetic relays 63 and 64 are each provided with a common contact 63*c* or 64*c*, a normally open contact 63*a* or 64*a* which is in contact with the corresponding common contact 63*c* or 64*c* when the corresponding coil 65 or 66 is energized, and a normally closed contact 63*b* or 64*b* which is in contact with the corresponding common contact 63*c* or 64*c* when the corresponding coil 65 or 66 is de-energized. The DC motor 13 is connected across the two common contacts 63*c* and 64*c*. The normally open contacts 63*a* and 64*a* are commonly connected and further connected to the output end of the thermistor 69, while normally closed contacts 63*b* and 64*b* are commonly connected and grounded via a resistor 70 and a transistor 71 which are described hereinafter.

A current detector 72 is connected across the resistor 70, and supplies a low signal to the reset input of the flip-flop circuit 60 when the voltage developed across the resistor 70 or, in other words, the current flowing across the DC motor 13 has exceeded a certain threshold level. The outputs of the AND circuits 57 and 58 are connected to the inputs of AND circuits 73 and 74, respectively, whose other inputs are connected to a first pulse generator 75 and a second pulse generator 76, respectively, having a same frequency but different duty ratios. The outputs of these AND circuits 73 and 74 are connected to the inputs of an OR circuit 77 whose output is connected to the base of the transistor 71. The emitter of this transistor 71 is grounded.

Figure 9:
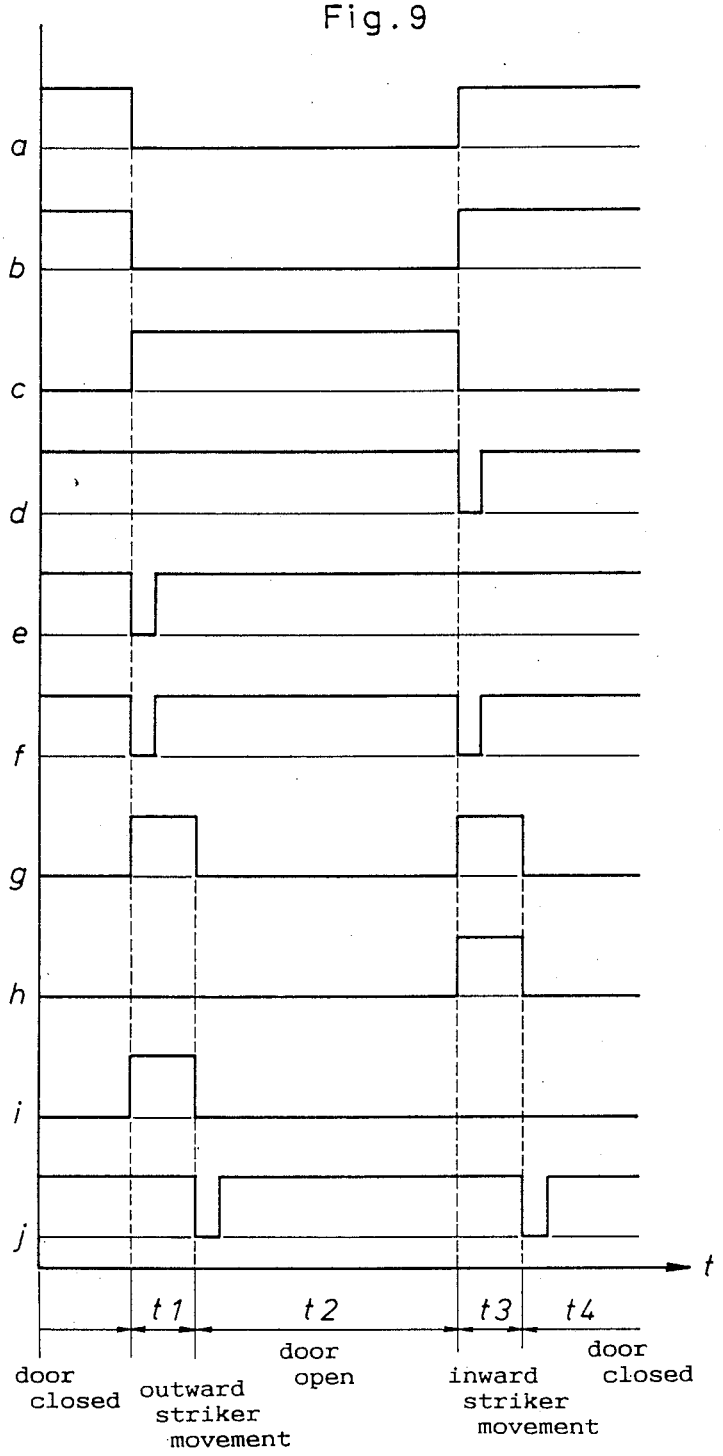
FIG. 9 is a time chart for explaining the operation of the, control unit shown in FIG. 8.

Now the operation of the present embodiment is described in the following with reference to the flow chart of FIG. 9 as well as the circuit diagram of FIG. 8.

When the door is completely closed, the latch switch 41 is fully depressed as shown in FIG. 7 to indicate the fully latched state of the latch member 36. Therefore, the contact set 41*a* of the latch switch 41 is open, and the output level of the buffer 51 is high. Initially, the coils 65 and 66 of the electromagnetic relays 63 and 64 are both de-energized, and the DC motor 13 is stationary with its both ends disconnected from the power line. Meanwhile, the eccentric cam 27 and the final gear 29 are at the positions indicated in FIGS. 3 and 4, and the striker 10 is located inwardly of the vehicle body 5 as indicated by the solid lines in FIG. 1

When the engagement between the ratchet pawl 38 and the full-latch ratchet tooth 37*b* is released by actuating a door handle (not shown in the drawings) or the like, the latch member 36 turns in the clockwise direction in FIG. 7 under the spring force of the return spring, and the contact set 41*a* of the latch switch 41 becomes closed at $t=t_1$. As result, a low level signal (signal at a) is produced from the output of the buffer 51, and reverses the input levels of the two edge detecting circuits 53 and 54 from high to low. Therefore, the leading edge detecting circuit 53 reverses its output level (signal b) from high to low while the trailing edge detecting circuit 54 reverses its output (signal c) from low to high. The output levels of the one-shot pulse generators 55 and 56 are normally high, but each of them produces a low level pulse of a fixed duration (signals d and e) when its input level changes from low to high. Therefore, the output signal (signal c) from the trailing edge detector 54 causes a low level pulse to be produced from the one-shot pulse generator 56 and hence from the output (signal f) of the AND circuit 59. The low level pulse sets the flip flop circuit 60 or reverses the output (signal g) from the flip-flop circuit 60 from low to high. As a result, the output level (signal i) of the AND circuit 58 is pulled up to high level while the output level (signal h) of the other AND circuit 57 is kept low.

In this condition, the output of the NOT circuit 62 is pulled down, thereby causing the coil 66 to be energized while the other coil 65 is kept de-energized. This produces an electroconductive path from the battery 67 to the ground, via the thermistor 69, the contacts 64*a* and 64*c*, the motor 13, the contacts 63*c* and 63*b*, the resistor 70 and the transistor 71, and drives the DC motor 13 in the normal direction at relatively high speed because the output of the AND circuit 58 enables the AND gate 73 and the first pulse generator 75 has a larger duty ratio than the second pulse generator 76. This is advantageous because the vehicle occupant typically expects and desires an immediate unlatching action when he acts upon the door handle with the intention to open the door.

As the output shaft of the DC motor 13 turns in the normal direction, the eccentric cam 27 as well as the final gear 29 turns in the clockwise direction in FIGS. 3 and in the counter-clockwise direction in FIG. 4, thereby moving the cam follower 24 to the left in FIG. 3. The leftward motion of the cam follower 24 causes the slider member 17 and the striker 10 to be moved outwardly of the vehicle body along the guide cavity 16 as shown by imaginary lines in FIG. 1. Since the range of the rotational angle of the final gear 29 is limited by the pin 33 received in the arcuate slot 32 of the final gear 29, when the eccentric cam 27 has rotated by the angle determined by this limiting mechanism, the motor 13 is mechanically stalled or overloaded.

This mechanical overloading is detected by the current detector 72 as an excessive electric current flowing through the motor 13, and the output (signal j) of the current detector 72 is pulled down to a low level at time $t=t_2$. This resets the flip-flop circuit 60 and reverses the output of the flip-flop circuit from high to low. This, in turn causes the coil 66 to be de-energized, and stops the motor 13 by forming a contact between the common contact 64*c* and the normally closed contact 64*b* instead of between the common contact 64*c* and the normally open contact 64*a*, thereby dissolving the state of overloading.

When the door 1 is closed from this condition, as shown in FIGS. 5 through 7, the striker 10 is received in the notch 39 and turns the latch member 36 in counterclockwise direction. Since the striker 10 is located at its external position with respect to the vehicle body 5, it is possible to achieve a fully latched state without the weather strip being fully compressed by the door 1. Therefore, the fully latched state can be easily achieved by lightly closing the door 1 because the weather strip is not required to be fully compressed yet.

The inner most part of the guide slot 34 of the latch mechanism 4 is provided with a cushion member 43 for elastically receiving the striker 10 and preventing the generation of unattractive metallic noises. Because the striker 10 is located more outwardly than normal, this cushion member 43 receives a substantially larger impact force from the striker 10 because the cushion member 43 is not assisted by the weather strip 9 in receiving the impact force from the door 1. Therefore, according to the present embodiment, another cushion member 44 is attached to the base plate 19 of the striker 10 to abut an end surface of the casing 35 adjacent to the guide slot 34 to receive the impact force arising from the closure of the door 1.

When the latch member 36 has turned to its fully latched position shown in FIG. 7, the latch switch 41 is depressed and the contact set 41*a* opens at time $t=t_3$. The output signal from the latch switch 41 reverses the input signal to the pulse edge detecting circuits 53 and 54 from low to high, whereby the output level (signal b) of the leading edge detecting circuit 53 changes from low to high and the output level (signal c) of the trailing edge detecting circuit 54 changes from high to low. Therefore, the one-shot pulse generator 55 produces a low level pulse signal of a short duration (signal d), and sets the flip-flop circuit 60 into a high level. The output signal (signal g) from the flip-flop circuit 60 is supplied to the AND circuits 57 and 58, and, because the output level (signal b) of the pulse leading edge detecting circuit 53 is high while the output level (signal c) of the pulse trailing edge detecting circuit 54 is low, the coil 65 is energized while the other coil 66 is deenergized. This produces an electroconductive path from the battery 67 to the ground, via the thermistor 69, the contacts 63*a* and 63*c*, the motor 13, the contacts 64*c* and 64*b*, the resistor 70 and the transistor 71, and drives the DC motor 13 in the reverse direction at relatively low speed because the output of the AND circuit 57 enables the AND gate 74 and the second pulse generator 76 has a smaller duty ratio than the first pulse generator 75. This is advantageous because any excessively abrupt motion of the striker may have an alarming effect on the vehicle occupant, and, additionally, increases the risk of inadvertent interposition of an object between the door and the vehicle body.

As the motor 13 turns in the reverse direction, and the eccentric cam 27 turns to the position shown in FIG. 3, the cam follower 24, along with the slider member 17 and the striker 10, is moved along the guide slot 16 inwardly of the vehicle body 5 until the door 1 is fully closed as shown in FIG. 1.

When the eccentric cam 27 has rotated over the predetermined angle, the electric motor 13 is again mechanically stalled or overloaded with the pin 33 abutting a terminal end of the arcuate slot 32. The resulting overcurrent flowing across the motor 13 is detected by the current detector 72 which in turn resets the flip-flop circuit 60 into low level, and stops the motor 13.

The latch mechanism of a vehicle door is required to be able to withstand a substantial force which tends to open the door. Such a force typically arises from the negative pressure which develops along the sides of the vehicle as it cruises at high speed as well as from the elastic reaction from the weather strip. Therefore, the cam mechanism 11 is required to be capable of withstanding such a strong force.

As well known, in an eccentric cam mechanism, a critical state or a top dead center is generated when the line passing through the rotational center of the eccentric cam and the point of contact with the cam follower runs in parallel with the direction of the sliding motion of the cam follower. However, because of dimensional manufacturing errors which are inevitable to a certain extend, it may not be possible to achieve an ideal top dead center in every case.

Figure 10:
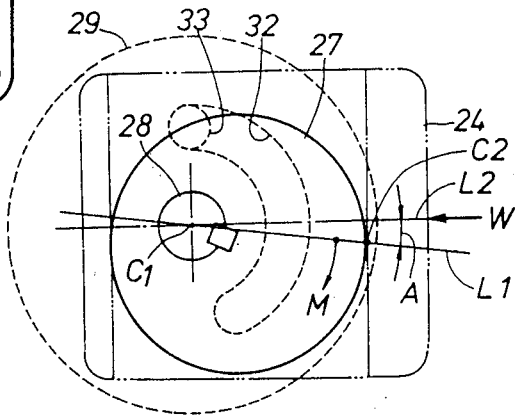
FIG. 10 is an end view similar to FIG. 3 to show why the cam is immobile against any external force applied thereto.

According to the present embodiment, this problem is solved by placing the final position of the cam 27 defined by one of the terminal ends of the slot 32 and the pin 33 at such an angular position that the line $L_1$ passing through the center $C_1$ of the cam shaft 28 and the point of contact $C_2$ between the eccentric cam 27 and the cam follower 24 is more advanced by an angle A than the line $L_2$ along which the cam follower 24 slides, as shown in FIG. 10.

Owing to this geometrical relationship, when the door is fully closed, the force W acting upon the cam follower 24 via the striker 10 in the direction to open the door produces a rotary moment as indicated by an arrow M acting upon the eccentric cam 27, but, since the rotation of the cam shaft 28 is securely prevented by the abutting of the pin 33 to a terminal end of the arcuate slot 32, the cam follower 24 as well as the striker 10 is securely held at their current positions. In other words, the final position of the cam 27 is slightly beyond its top dead center when the door is fully closed, and is fixedly secured at this position by the abutment of the pin 33 to the terminal end of the arcuate slot 32. Therefore, the cam 27 is positively prevented from being moved by an external force which, for instance, directed to open the door.

Figure 11:
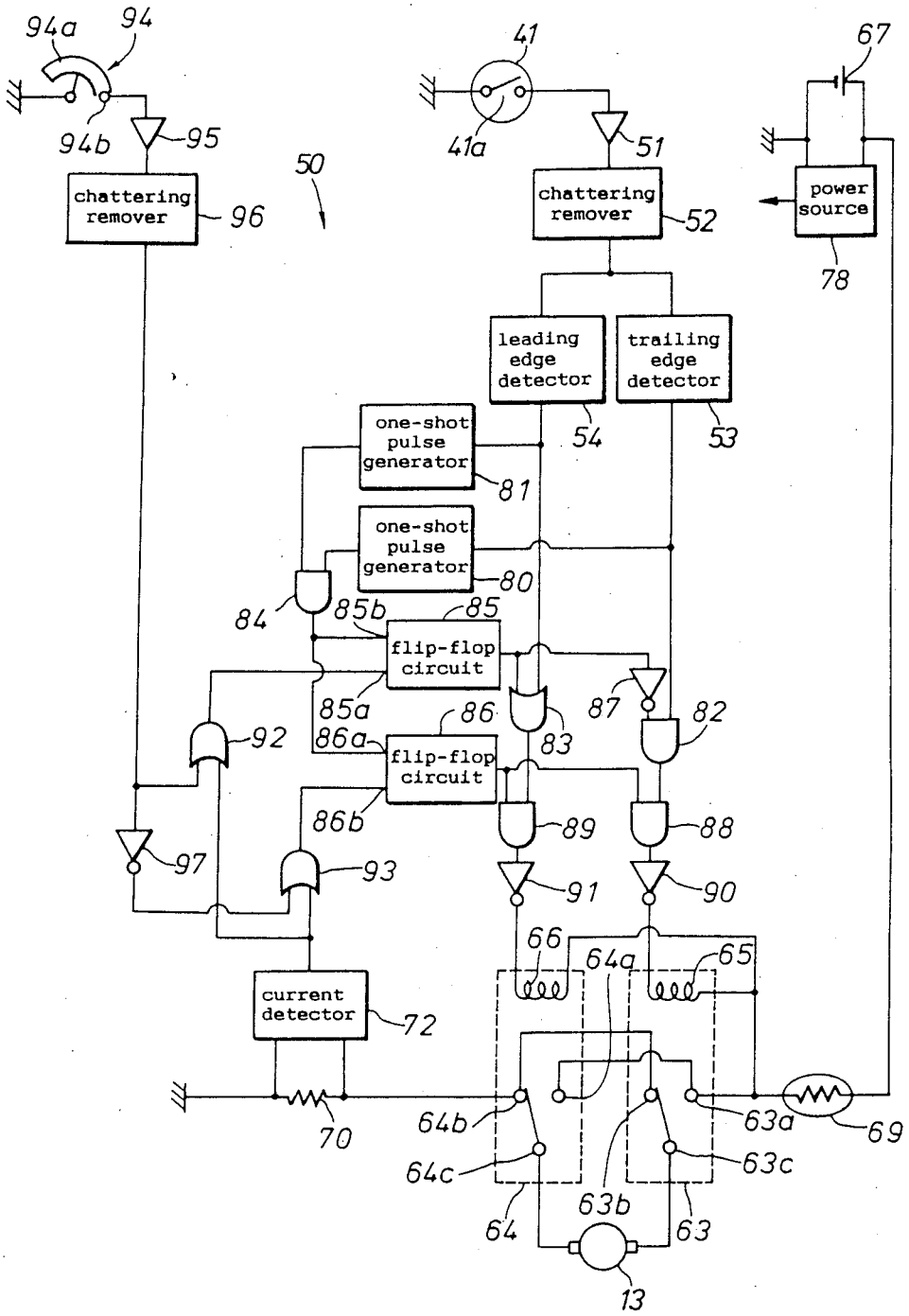
FIG. 11 is a block diagram of a second embodiment of the control unit for the active door latch assembly.

FIG. 11 shows a block diagram of another embodiment of the control unit for the active door latch assembly according to the present invention. The parts corresponding to those of the previous embodiment are denoted with like numerals.

This control circuit comprises the latch switch 41, a buffer circuit 51, a chattering removing circuit 52, a pulse leading edge detecting circuit 53 and a pulse trailing edge detecting circuit 54 which are similar to those of the previous embodiment. The output of the leading edge detecting circuit 53 is connected to the input of a one-shot pulse generator 80 and an input of an AND circuit 82 while the output of the trailing edge detecting circuit 54 is connected to the input of another one-shot pulse generator 81 and an input of an OR circuit 83.

The outputs of the one-shot pulse generators 80 and 81 are connected to the inputs of an AND circuit 84 whose output is connected to the reset input **85*b* and the set input 86*a* of two flip-flop circuits 85 and 86, respectively. The output of one of the flip-flop circuits 85 is connected to the other input of the 0R circuit 83 and, via a NOT circuit 87, to the other input of the AND circuit circuit 82. The output of the other flip-flop circuit 86 is connected to the inputs of AND circuits 88 and 89. The outputs of the AND circuit 82 and the OR circuit 83 are connected to the other inputs of the AND circuits 88 and 89, respectively. The outputs of the AND circuits 88 and 89 are connected to the ground ends of the coils 65 and 66 of relays 65 and 66, respectively, which are similar to the relays of the previous embodiment and control the operation of the motor 13**.

The ground end of the motor circuit is grounded via a resistor 70 across which a current detector 72 is connected. The output of the current detector 72 is connected to the inputs of OR circuits 92 and 93.

According to the present embodiment, the final gear 29 carries an auxiliary contact set 95 which comprises a moveable contact piece **95*a* extending over a certain angular range about the center of rotation of the final gear 29 and a fixed contact piece 95*b* which is in sliding contact with the moveable contact piece 95*a*. This contact set 95 is open when the final gear 29 is in the vicinity of the two extreme angular positions but is grounded when the final gear 29** is at any intermediate position therebetween.

The output of this contact set 95 is connected to a chattering removing circuit 96, and the output thereof is directly connected to the other input of the OR circuit 92 and, via a NOT circuit 97, to the other input of the OR circuit 93. The outputs of the OR circuits 92 and 93 are connected to the set input **85*a* and the reset input 86*b* of the flip-flop circuits 85 and 86**, respectively.

Now the operation of this control circuit is described in the following, primarily about the parts which are different from the previous embodiment.

When the door is attempted to be opened from its closed state by unlatching the latch mechanism with a door handle or the like, a pulse signal from the AND circuit 84 resets and sets the flip-flop circuit 85 and 86, respectively, whereby the output levels of the flip-flop circuit 85 and 86 are brought to low and high levels, respectively. This in turn causes the outputs of the AND circuit 82 and the OR circuit 83 to be low and high, respectively. As a result, the output of the AND circuit 88 is brought low, and the output of the NOT circuit 90 is hence brought high. Likewise, the output of the AND circuit 89 is brought high, and the output of the NOT circuit 91 is hence brought low. Therefore, an electroconductive path is formed from the battery 67 to the ground, via the thermistor 69, the contacts **64*a* and 64*c*, the motor 13, the contacts 63*c* and 63*b* and the resistor 70, and the DC motor 13 is driven in the normal direction. This rotational motion continues until the final gear 29 is mechanically stalled by the engagement between the pin 33 and the slot 32. The auxiliary contact 94 is grounded and supplies a low signal to the OR circuit 92 and, via the NOT circuit 97, a high signal to the OR circuit 93 while the final gear 29 is at an intermediate position. Therefore, as long as the motor current is normal and the output level of the current detector 72 is high, the states of the flip-flop circuits 92 and 93** are kept fixed.

When the door is attempted to be closed from its open state by latching the striker to the latch mechanism, a pulse signal from the AND circuit 84 resets and sets the flip-flop circuit 85 and 86, respectively, whereby the output levels of the flip-flop circuit 85 and 86 are brought to low and high levels, respectively. This in turn causes the outputs of the AND circuit 82 and the OR circuit 83 to be low and high, respectively. As a result, the output of the AND circuit 88 is brought high, and the output of the NOT circuit 90 is hence brought low. Likewise, the output of the AND circuit 89 is brought low, and the output of the NOT circuit 91 is hence brought high. Therefore, an electroconductive path is formed from the battery 67 to the ground, via the thermistor 69, the contacts **63*a* and 63*c*, the motor 13, the contacts 64*c* and 64*b* and the resistor 70, and the DC motor 13 is driven in the reverse direction. This rotational motion continues until the final gear 29 is mechanically stalled by the engagement between the pin 33 and the slot 32. The auxiliary contact 94 is grounded and supplies a low signal to the OR circuit 92 and, via the NOT circuit 97, a high signal to the 0R circuit 93 while the final gear 29 is at an intermediate position. Therefore, as long as the motor current is normal and the output level of the current detector circuit 72 is high, the states of the flip-flop circuits 92 and 93** are kept fixed.

Suppose that a foreign object is interposed between the door 1 and the vehicle body. In this case, the auxiliary contact 94 is grounded but the motor current increases beyond the threshold level. As a result, the inputs to the OR circuits 92 and 93 from the auxiliary contact set 94 remain the same, but the current detector 72 supplies a low level pulse to the OR circuits 92 and 93. Therefore, a low signal is supplied to the set input **85*a* of the flip-flop circuit 85, and the output of the flip-flop circuit 85 is pulled up. This reverses the output states of the AND circuit 82 and the OR circuit 83, and hence the output states of the AND circuits 88 and 89, thereby reversing the rotational direction of the motor 13**, or driving the motor in the normal direction to open the door.

Thus, according to this embodiment, the door closing action is interrupted and reversed if any foreign object is interposed between the vehicle body and the vehicle door, and the safety of the active door latch assembly can be much improved.

Typically, fine adjustment between the door and the vehicle body is attained by adjusting the position of the striker. In the case of the present embodiment, since the holes **19*b* of the base plate 19 which receive the screws 19*a* are larger in size than the diameter of the screws 19, it can be accomplished by loosening the screws 19*a* which fixedly secure the base plate 19, adjusting the position of the base plate 19, and fastening the screws 19*a* again. In particular, because the slider 17 and the base plate 19 of the striker 10 consist of separate members, the position of the striker 10 may be adjusted without altering the position of the striker drive mechanism 8**.

According to the present embodiment, the limits of the stroke of the motion of the cam 27 is given by the pin 33 received in the arcuate slot 32 of the final gear 29, and the electric current flowing through the motor was monitored to detects the limits, but it is also possible to use a pulse counter or the like which constantly monitors the rotation of the motor. Also, the stalled state of the motor may be detected by monitoring magnetic parameters.

As an alternate arrangement, a latch switch 42 may be provided adjacent to the pawl 38 to detect the fully latched state from the motion of the pawl 38, as shown by imaginary lines in FIG. 7, instead of using the latch switch 41. According to this alternate arrangement, the motion of the striker 10 may be started substantially at the same time as the returning motion of the latch member 36. Therefore, the striker 10 starts moving outwardly before the striker 10 is released from the latch member 36, and it is therefore possible to prevent noises from being generated as the striker 10 is disengaged from the latch member 36.

Although the above embodiments derived power from a DC motor, it is possible to use other power sources such as hydraulic power without departing from the spirit of the present invention. Also, the present invention may be applied to other kinds of closure members, such as tail gates, trunk lids and so on, and the latch mechanism may be adapted to move toward and away from the center of the vehicle, instead of the striker. Further, the positions of the striker and the latch mechanism may be reversed, and the latch mechanism may be moved, instead of the striker, to achieve the same goal, without departing from the spirit of the present invention.

What we claim is:

1. An active door latch assembly, comprising:

a striker mounted on a vehicle body so as to be moveable inwardly toward and outwardly away from said vehicle body by a certain stroke;

a latch mechanism mounted on a closure member such as a door for latching said striker thereto upon closing of said closure member against said vehicle body;

electrically powered drive means for moving said striker toward and away from said vehicle body;

detecting means provided separately from said latch mechanism for directly detecting a latched and unlatched state of said latch mechanism; and control means for activating said electrically powered drive means so as to move said striker away from said vehicle body when said detecting means has detected the unlatching of said latch mechanism and towards said vehicle body when said detecting means has detected the latching of said latch mechanism;

wherein said latch mechanism includes a movable latch member which can move between a latch position to engage said striker and an unlatched position to disengage said striker, and a pawl member which engages said latch member at said latched position; and said detecting means comprises a limit switch which is activated by said pawl member as the latter moves to a position activated by said pawl member as the latter moves to a position to engage said latch member at said latched position.

2. An active door latch assembly, comprising:

a striker mounted on a vehicle body so as to be moveable inwardly toward and outwardly away from said vehicle body by a certain stroke;

a latch mechanism mounted on a closure member such as a door for latching said striker thereto upon closing of said closure member against said vehicle body;

electrically powered drive means for moving said striker toward and away from said vehicle body;

detecting means provided separately from said latch mechanism for directly detecting a latched and unlatched state of said latch mechanism; and control means for activating said electrically powered drive means so as to move said striker away from said vehicle body when said detecting means has detected the unlatching of said latch mechanism and towards said vehicle body when said detecting means has detected the latching of said latch mechanism;

wherein said powered drive means includes and electric motor to move said striker, and said control means comprises a current detector for detecting the electric current supplied to said motor and for stopping said motor when the detected electric current has exceeded a certain threshold level.

3. An active door latch assembly, comprising:

a striker mounted on a vehicle body so as to be moveable inwardly toward and outwardly away from said vehicle body by a certain stroke;

a latch mechanism mounted on a closure member such as a door for latching said striker thereto upon closing of said closure member against said vehicle body;

electrically powered drive means for moving said striker toward and away from said vehicle body;

detecting means provided separately from said latch mechanism for directly detecting a latched and unlatched state of said latch mechanism; and control means for activating said electrically powered drive means so as to move said striker away from said vehicle body when said detecting means has detected the unlatching of said latch mechanism and towards said vehicle body when said detecting means has detected the latching of said latch mechanism;

wherein said powered drive means includes an electric motor to move said striker; and said control means comprises means to detect the position of said striker, and a current detector for detecting the electric current supplied to said motor and for reversing said motor when said striker is at a position intermediate between limits of its permitted stroke of motion and, at the same time, the detected electric current has exceeded a certain threshold level.

4. An active door latch assembly, comprising:

a striker mounted on a vehicle body so as to be moveable inwardly toward and outwardly away from said vehicle body by a certain stroke;

a latch mechanism mounted on a closure member such as a door for latching said striker thereto upon closing of said closure member against said vehicle body;

electrically powered drive means for moving said striker toward and away from said vehicle body;

detecting means provided separately from said latch mechanism for directly detecting a latched and unlatched state of said latch mechanism; and control means for activating said electrically powered drive means so as to move said striker away from said vehicle body when said detecting means has detected the unlatching of said latch mechanism and towards said vehicle body when said detecting means has detected the latching of said latch mechanism;

wherein said control means controls said powered drive means so as to move said striker at a slower rate when moving said striker towards said vehicle body than then moving said striker away from said vehicle body.

5. An active door latch assembly as defined in claim 2, 3, or 4, wherein said latch mechanism includes a moveable latch member which can move between a latched position to engage said striker and an unlatched position to disengage said striker, and said detecting means comprises a limit switch which is activated by said latch member when the latter is at said latched position.

6. An active door latch assembly as defined in claim 1, 2, 3, or 4, wherein said powered drive means includes stopper means for limiting the stroke of the motion of said powered drive means, said stopper means comprising a concentric arcuate slot formed in a rotary member of said powered drive means, and a fixed pin which is received in said arcuate slot to define a limit to the rotational angle of said rotary member by abutting to a terminal end of said arcuate slot.

7. An active door latch assembly as defined in claim 1, 2, 3, or 4, wherein said powered drive means includes a power transmission mechanism which is irreversible in the latched state in the sense that said striker is immobile against any external force applied directly thereto.

8. An active door latch assembly as defined in claim 6, wherein said powered drive means includes an eccentric cam for driving said striker, and said stopper means stops said eccentric cam at a position slightly beyond its top dead center when the door is fully closed.

9. An active door latch assembly as defined in claim 1, 2, 3 or 4, wherein said powered drive means includes an eccentric cam for driving said striker, and said stopper means stops said eccentric cam at a position slightly beyond its top dead center when the door is fully closed.

* * * * *

UNITED STATES PATENT AND TRADEMARK OFFICE

CERTIFICATE OF CORRECTION

PATENT NO. : 4,982,984

DATED : January 8, 1991

INVENTOR(S) : Yokota et al

It is certified that error appears in the above-indentified patent and that said Letters Patent is hereby corrected as shown below:

On the title page, item [73] Assignee: please add after "Japan" --Kabushiki Kaisha Honda Lock, Miyazaki-ken, Japan--.

Signed and Sealed this

Ninth Day of May, 1995

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 4,982,984

DATED : January 8, 1991

INVENTOR(S) : Yokota et al.

It is certified that error appears in the above-indentified patent and that said Letters Patent is hereby corrected as shown below:

On the title page, under "Assignee", please add after "Japan" --Kabushiki Kaisha Honda Lock, Miyazaki-ken, Japan--.

Signed and Sealed this

Twenty-first Day of November, 1995

Bruce Lehman

*Attest:*

BRUCE LEHMAN

*Attesting Officer*

*Commissioner of Patents and Trademarks*